US012163304B1

(12) United States Patent
Parsi

(10) Patent No.: US 12,163,304 B1
(45) Date of Patent: Dec. 10, 2024

(54) MODULAR FORM

(71) Applicant: Ramin Parsi, Carlsbad, CA (US)

(72) Inventor: Ramin Parsi, Carlsbad, CA (US)

( * ) Notice: Subject to any disclaimer, the term of this patent is extended or adjusted under 35 U.S.C. 154(b) by 0 days.

(21) Appl. No.: 18/401,523

(22) Filed: Dec. 31, 2023

(51) Int. Cl.

| | |
|---|---|
| ***E02D 5/12*** | (2006.01) |
| ***E02D 5/52*** | (2006.01) |
| ***E02D 5/80*** | (2006.01) |
| ***E02D 27/08*** | (2006.01) |
| ***E04G 11/00*** | (2006.01) |
| *E02D 27/50* | (2006.01) |

(52) U.S. Cl.
CPC ..... *E02D 27/08* (2013.01); *E02D 5/12* (2013.01); *E02D 5/526* (2013.01); *E02D 5/80* (2013.01); *E02D 27/50* (2013.01)

(58) Field of Classification Search
CPC ..... E02D 27/08; E02D 27/50; E02D 5/12; E02D 5/526; E02D 5/80; E04C 5/165; E04C 5/168; E04B 5/38; E04G 13/00
See application file for complete search history.

(56) References Cited

U.S. PATENT DOCUMENTS 3,044,561 A * 7/1962 Swiger ..... E02B 17/027 175/8
2004/0093824 A1* 5/2004 Huber ..... E04C 5/205 52/834
2008/0111049 A1* 5/2008 Huber ..... E02D 27/42 249/139
2018/0345535 A1* 12/2018 Monachino ..... B28B 7/0011
2021/0087773 A1* 3/2021 Lim ..... E02D 27/01
2023/0265628 A1* 8/2023 Miller ..... E02D 5/526 405/231
2023/0295891 A1* 9/2023 Bristow ..... E02D 27/016 52/223.13

* cited by examiner

*Primary Examiner* — Benjamin F Fiorello
*Assistant Examiner* — Stacy N Lawson
(74) *Attorney, Agent, or Firm* — Mchael D. Eisenberg

(57) ABSTRACT

A modular form comprises a base plate, one or more connection units, a plurality of rebar supports. The base plate has a plurality of knock-outs, each knock-out being configured to be removed to generate a traversable by a pile. The connection units are aligned with respective knock outs, and are joined to the base plate and held above the base plate, to receive a pile to establish a connection between the pile and the form. The rebar supports are configured to support rebars above the base plate, and at least some of the rebar supports are configured to be joined to a portion of a connector, the remaining portion of the connector is: joinable to a rebar support of a second modular form, thereby joining the modular form to the second modular form; or joined to a form wall, thereby joining the modular form to the form wall.

19 Claims, 8 Drawing Sheets

MODULAR FORM

TECHNICAL FIELD

This invention relates to the field of construction. More specifically the present invention relates to, but is not limited to, the construction of foundations on an uneven terrain.

BACKGROUND OF THE INVENTION

Construction of buildings and roads on uneven terrain is challenging. The soil needs to be excavated, in order to create flat spaces upon which foundations are laid.

BRIEF SUMMARY OF EMBODIMENTS OF THE INVENTION

The present invention aims at providing foundations that can be placed on uneven soil without the need to excavate. The present invention allows foundations to be elevated above the soil.

Another aim of the present invention is to provide forms upon which foundations are built, that are modular. In this manner, the forms can connect be to each other to achieve a desired shape. Because of their limited size, modular forms can be fabricated away from the constructions site and transported to the construction site, where they are joined together to form the foundations of a building or road.

Therefore, an aspect of some embodiments of the present invention relates to a modular form comprising a base plate, one or more connection units, and a plurality of rebar supports. The base plate has a plurality of sides and at least one knock out, each knock out being configured to be removed to generate a respective perforation configured to be traversed by a pile. The one or more connection units are aligned with respective knock outs, the connections units being joined to the base plate and held above the base plate, each connection unit being configured to receive a pile to establish a connection between the pile and the form. The rebar supports are configured to support rebars above the base plate, wherein at least some of the rebar supports are configured to be joined to a portion of a connector, such that a remaining portion of the connector is: joinable to a rebar support of a second modular form, thereby joining the modular form to the second modular form; or joined to a form wall, thereby joining the modular form to the form wall, such that the form wall contacts the base plate and rises from the base plate.

In a variant, at least some of the rebar supports are lined in at least one row, each row located above and along a respective straight side of the base plate, wherein that a rebar is supported by a pair of rebar supports.

The rebar supports may be lined up, such that a first row is located above a second row above and along at least one straight side of the base plate.

In some embodiments of the present invention, each connection unit comprises an open or closed loop configured to be traversed by a pile.

In a variant, the modular form further comprising a cap configured to receive a pile within the cap and be secured to the pile, the cap having an upper section and a lower section, the upper section being larger than the loop and the lower section having an outer surface configured to traverse the loop.

In another variant, the lower section of the cap has an outer threading on the outer surface of the lower section of the cap, the cap's outer threading being configured to cooperate for connection to a threaded nut to secure the cap by sandwiching the loop between the upper section of the cap and threaded nut at the lower section cap, thereby securing the loop to the cap.

In yet another variant, the cap has an inner threading configured to cooperate with a threading of the pile, such that the cap is configured to be secured to the pile via cooperation between the cap's inner threading and the threading of the pile.

In a variant, the rebar supports comprise pipe segments extending parallel to the base plate.

The modular form may include one or more connectors, each of the connectors comprising a tube configured to partially enter any of the pipe segments and be secured to any the pipe segments via circumferential pressure between the tube and the pipe segment.

In another variant, the modular form comprises at least one support bracket joined to an upper surface of the base plate and to at least one of the connection units.

The at least one support bracket may be an angling bracket configured to change an angle of the at least one of the connection units with respect to the base plate.

In yet another variant, the modular form further comprises structure anchorage rods joined to the modular form and extending upward from the base plate.

In a further variant, the modular form of claim 1, further comprises cabling supports configured to retain post tension cabling.

In some embodiments of the present invention, the base plate has a recessed trough under at least one of the one or more connection unit.

In a variant, the modular form comprises a single connection unit and the recessed section is located under the single connection unit.

In another variant, the recessed section is shaped as at least troughs crossing each other under the single connection unit.

In some embodiments of the present invention, the base plate comprises two straight sides that do not touch each other and are in line with each other along a straight axis.

In a variant, the base plate comprises a curved side or a plurality of sides at non-zero angles with each other, located between the two straight sides, such that the form is shaped like half a loop defined by the shape of the curved side or the plurality of sides at non-zero angles with each other.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles.

Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
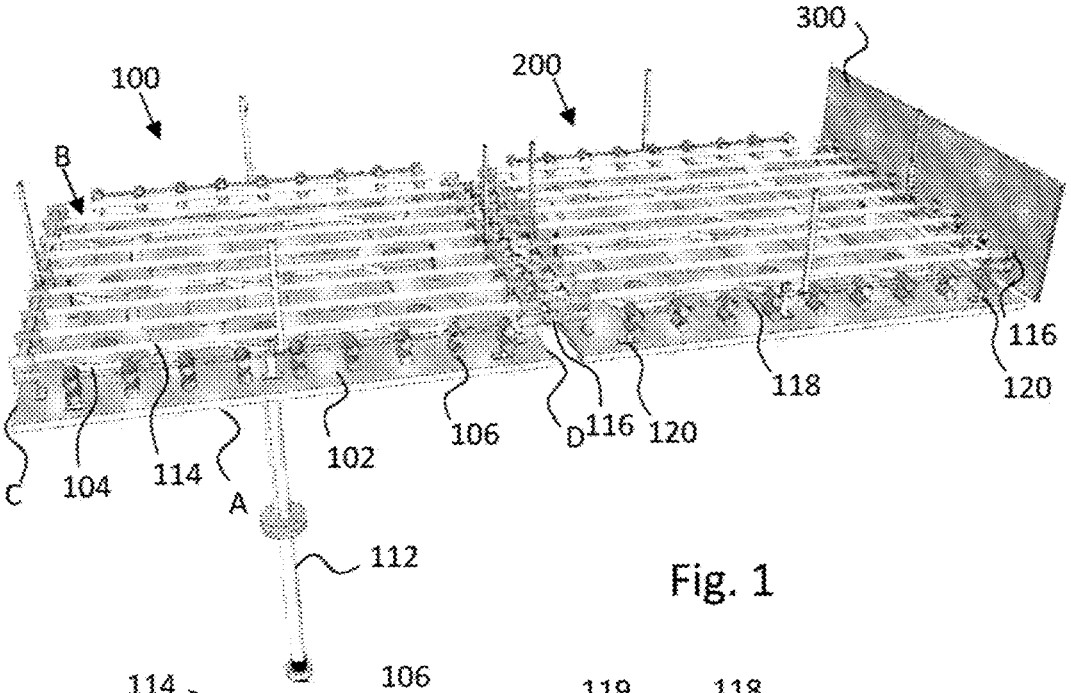
Figure 2:
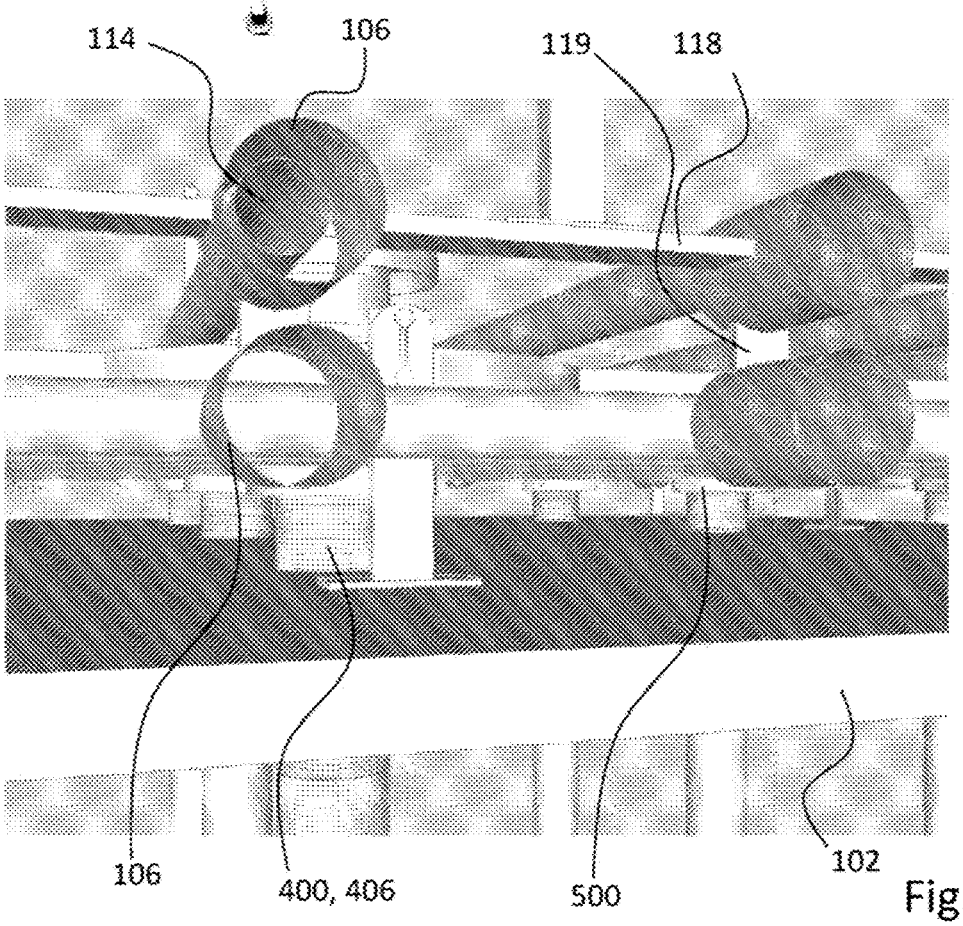
Figure 3:
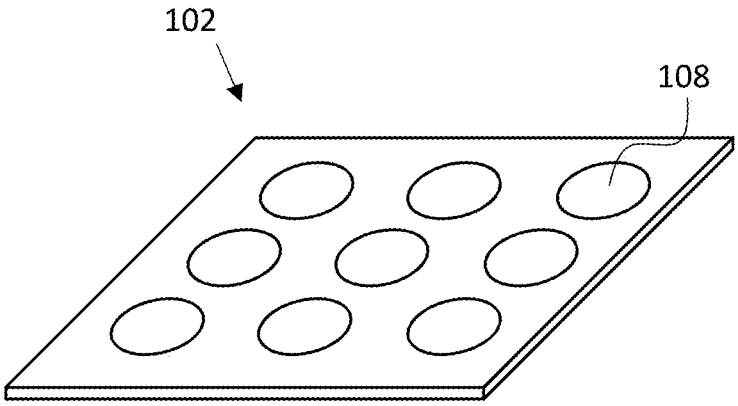
Figure 4:
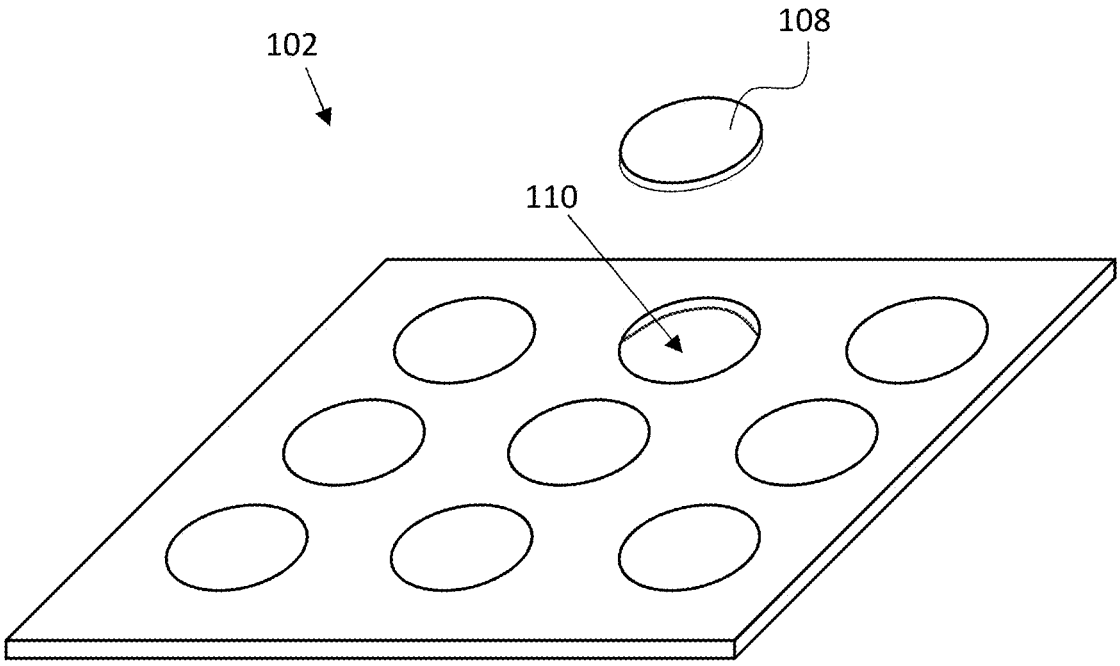
Figure 9:
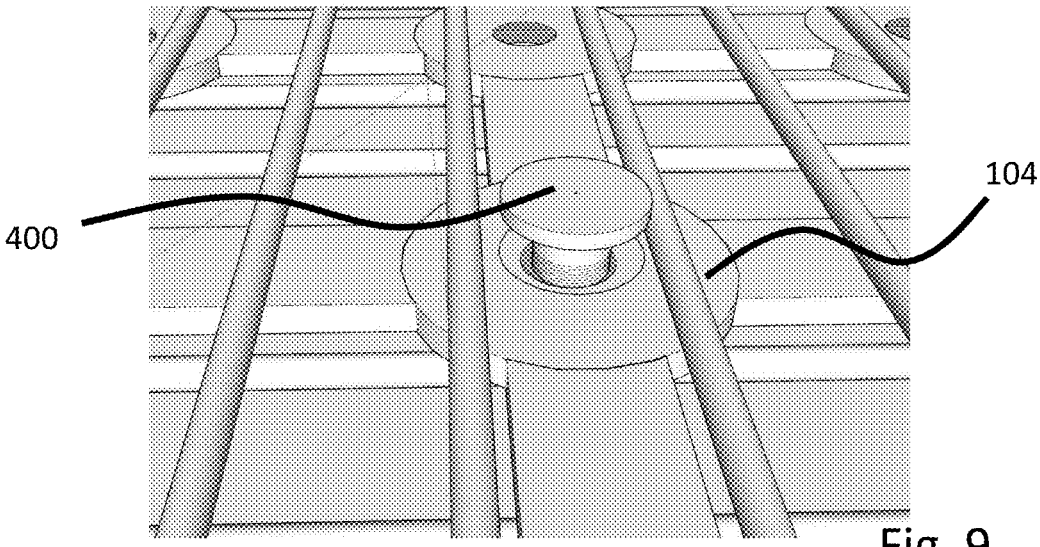
Figure 10:
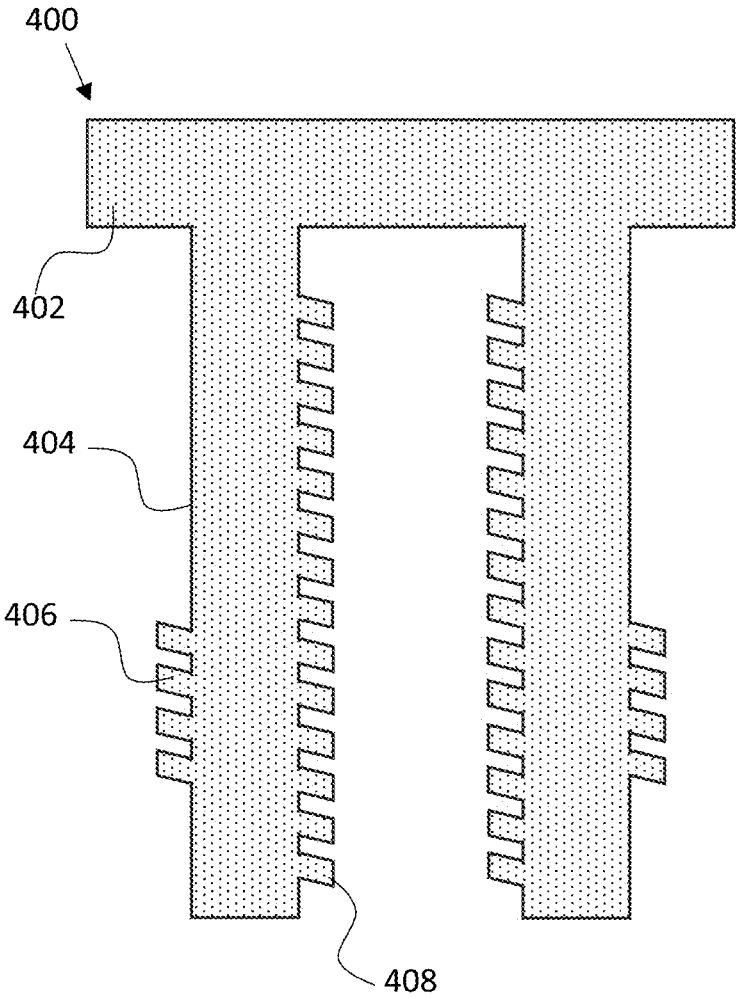
Figure 11:
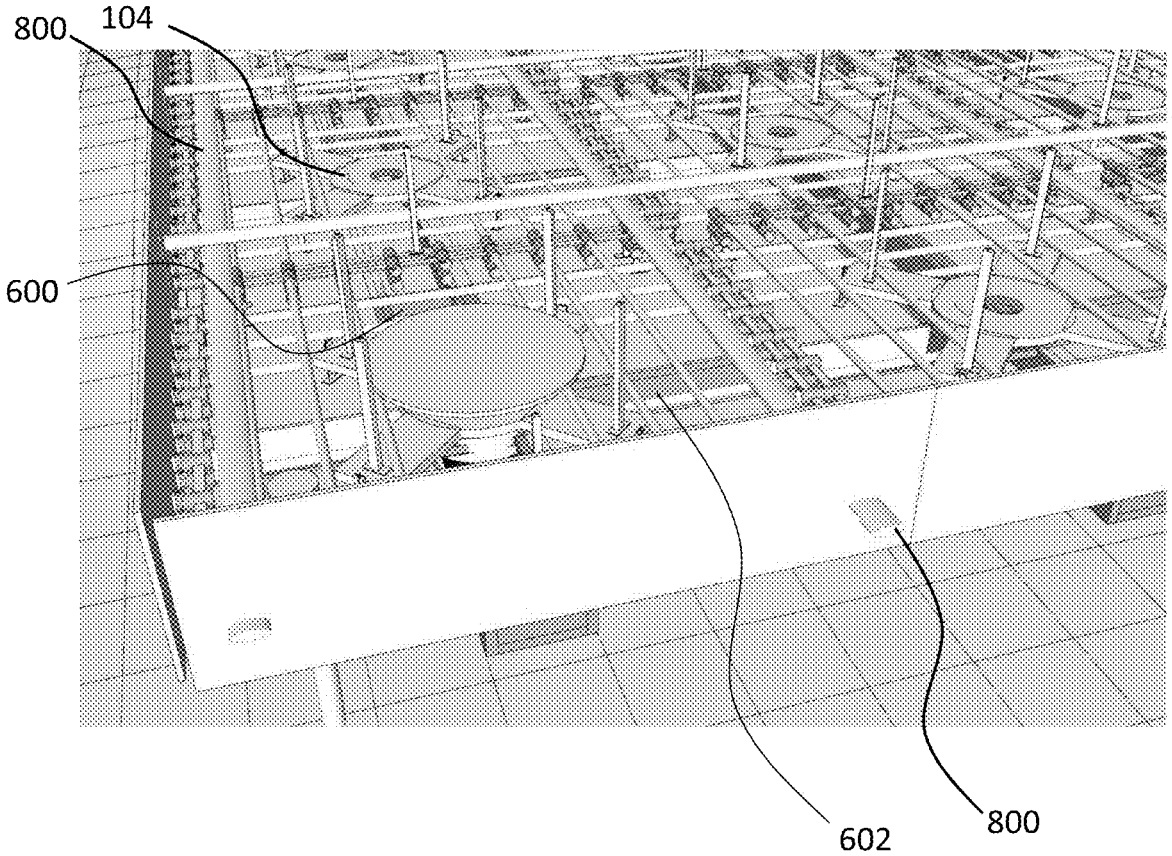
Figure 12:
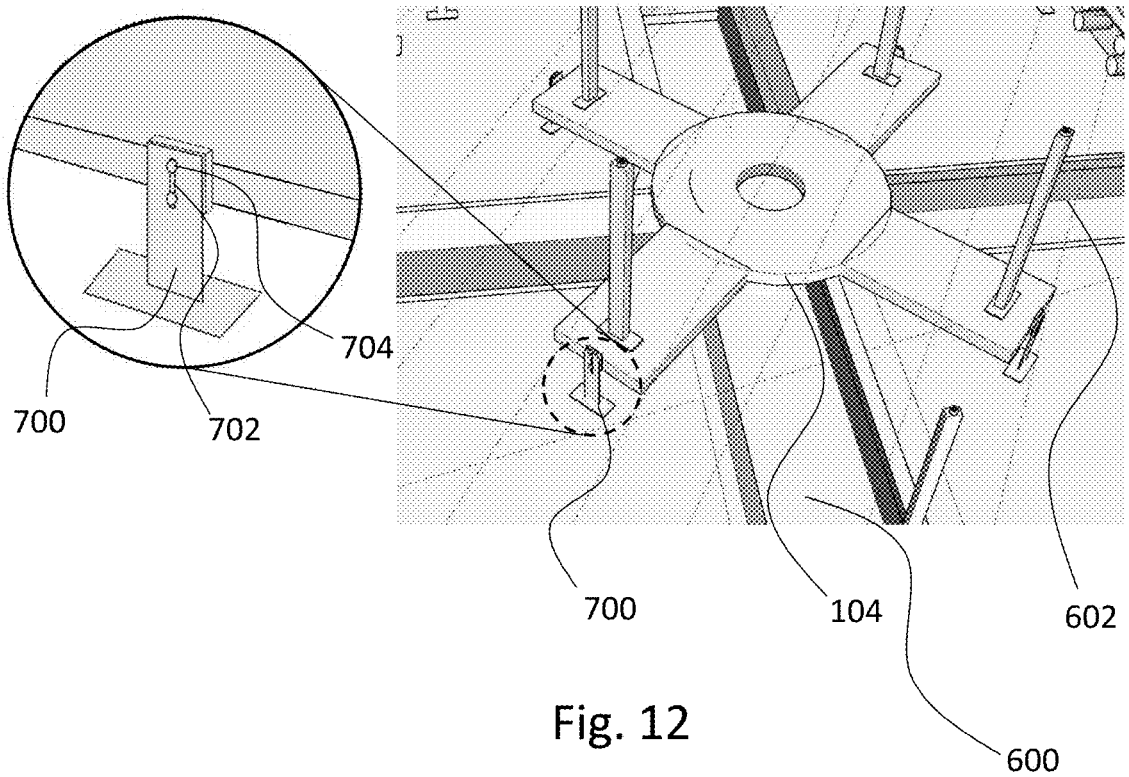
Figure 13:
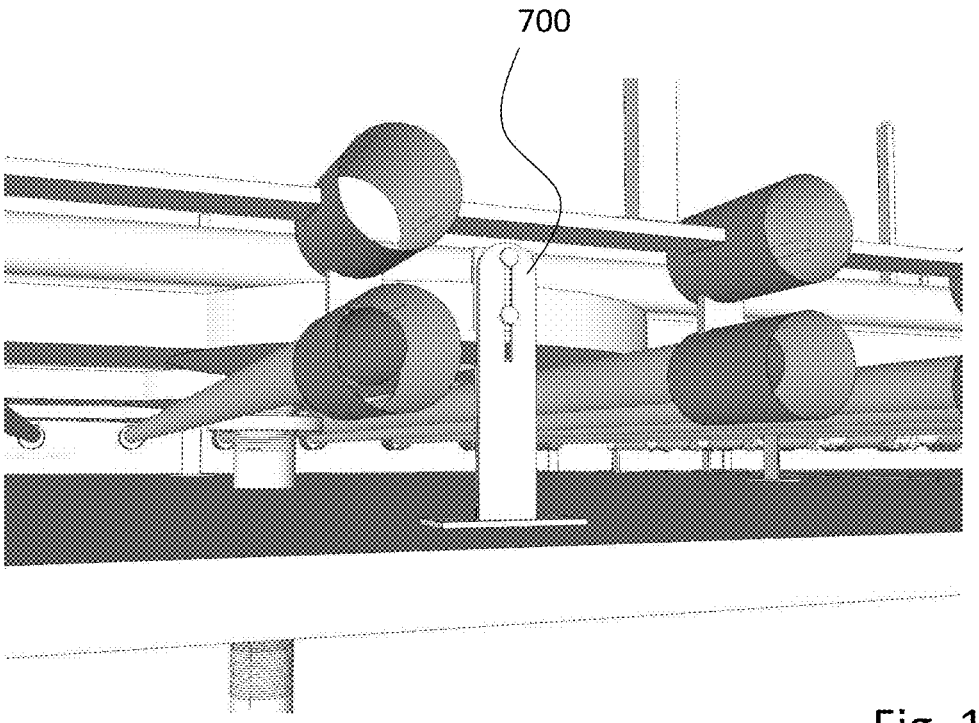
Figure 14:
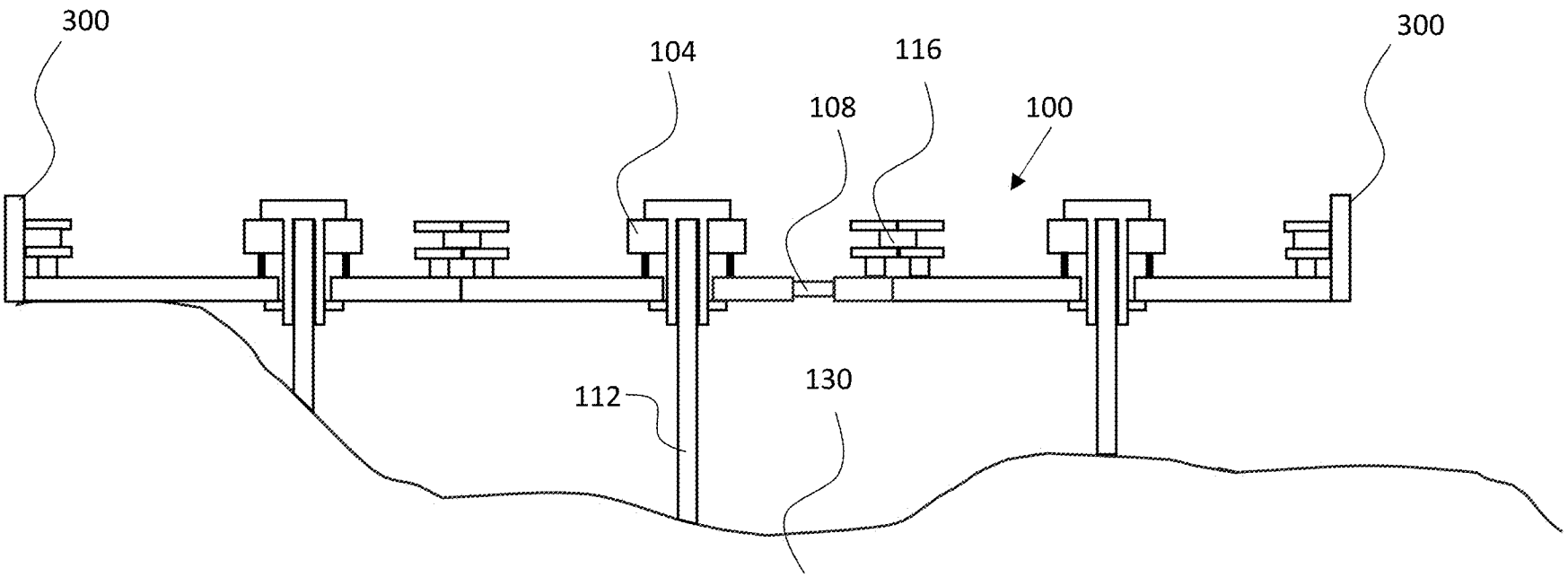
Figure 15:
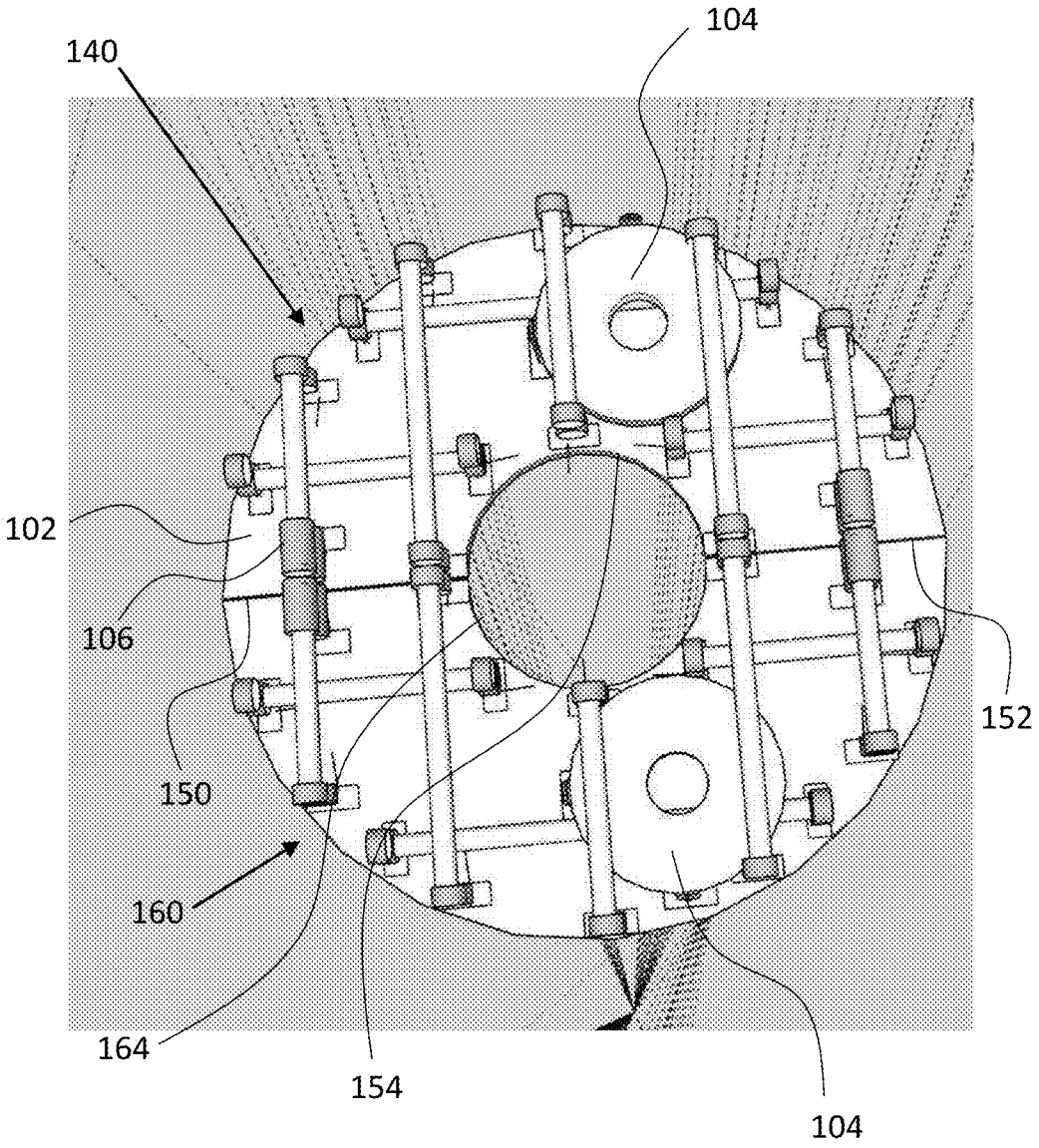

FIG. 1 is an exploded view of two modular forms, according to some embodiments of the present invention;

FIG. 2 is a detail of a modular form, showing rebar supports of the modular form, according to some embodiments of the present invention;

FIG. 3 illustrates an example of a base plate with knock-outs, according to some embodiments of the present invention;

FIG. 4 illustrates a base plate with a knock-out removed to create a perforation, according to some embodiments of the present invention;

FIGS. 5-8 illustrate cross sectional views for portions of the base plate. with different manners for connecting the knock-outs to the remainder of the base plate, according to some embodiments of the present invention;

FIG. 9 illustrates a cap configured to receive a pile, to connect the pile to the modular form, according to some embodiments of the present invention;

FIG. 10 is a cross sectional view of the cap of claim 9, according to some embodiments of the present invention;

FIG. 11 illustrates an example in which the connection unit is a single loop located about crossing throughs, according to some embodiments of the present invention;

FIG. 12 illustrates the connection unit of FIG. 11, with a plurality of support brackets supporting the connection unit, according to some embodiments of the present invention;

FIG. 13 illustrates an example in which the connection unit includes a plurality of parallel (optionally coplanar) loops joined together, and one of the support brackets supporting the connection unit, according to some embodiments of the present invention; and FIG. 14 is a cross sectional side view of a foundation formed by joining together a plurality of forms of the present invention, such that the foundation elevated above uneven terrain; and FIG. 15 is a perspective view of two forms of the present invention configured to create a loop when joined to each other, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Referring now to the drawings, FIG. 1 is an exploded view of two modular forms, according to some embodiments of the present invention. FIG. 2 is a detail of a modular form, showing rebar supports of the modular from, according to some embodiments of the present invention. FIG. 3 illustrates an example of a base plate with knock outs, according to some embodiments of the present invention. FIG. 4 illustrates a base plate with a knock-out removed to create a perforation, according to some embodiments of the present invention. FIG. 15 is a perspective view of two forms of the present invention configured to create a loop when joined to each other, according to some embodiments of the present invention.

A modular form 100 according to some embodiments of the present invention includes base plate 102, one or more connection units 104, a plurality of rebar supports 106.

The base plate 102 has a plurality of sides and at least one knock-out 108. Each knock-out 108 is configured to be removed to generate a respective perforation 110 on the base plate 102, the perforation 110 is configured to be traversed by a pile 112. At least one of the sides of the base plate 102 is straight.

The connection units 104 are aligned with respective knock-outs 108 and are joined to the base plate 102 and held above the base plate 102. Each connection unit is configured to receive a pile 112 to create a connection between the pile 112 and the form 100.

The rebar supports 106 are configured to support rebars 114 above the base plate 102. At least some of the rebar supports 114 are configured to be joined to a portion of a connector 116. The remaining portion of the connector may be connected to a rebar support of a second modular from 200 similar to the modular form 100, or to a wall 300. Joining connector 106 to rebar supports of two contiguous modular forms 100 and 200 joins the modular forms together. When the remainder of the connector 116 is joined to a wall 300, joining the connector 116 to a rebar support 106 of the modular form joins the modular form to the form wall 300, such that the form wall contacts the base plate and rises from the base plate. In FIG. 1, the modular form 200 is joined to the base plate.

The rebar supports 106 are therefore configured to support rebars 114 and some of the rebar supports are configured to connect a modular form to other modular forms and/or two wall. In this manner, a foundation is created.

As shown in FIG. 14, the piles 112 are rods fixed to the soil 130. The connection units 104 are configured to be fixed to the piles 112, thereby enabling the modular form 100 to be elevated above ground. Once the foundation is created by joining modular forms to each other via connectors 116 and by joining walls 300 to the modular forms and by placing rebars to be supported by the rebar supports, cement is poured on the foundation. The knock-outs 108 that have not been removed from the base plate 102 support the liquid cement, so that liquid cement does not pour out of the foundation.

In some embodiments of the present invention, at least some of the rebar supports 106 are lined in one or more rows. Each row located above and along a respective straight side of the base plate 102. In this manner, a rebar is supported by a pair of rebar supports. In the non-limiting example of FIG. 1, the base plate 102 is polygonal and has four straight sides. The rebar supports 106 are lined up in rows, one row above each side. In some embodiments of the present invention, the rebar supports 106 on opposite sides are aligned with each other, so that rebars 114 supported by pairs of rebar supports on the opposite sides are parallel to each other.

In the example of FIG. 15, the form 140 has the base plate 102 with two straight sides and two curved sides. The straight sides 150 and 152 are in line with each other along a straight axis and are located at opposing ends of one of a curved side 154. In this manner, the form is shaped as half a loop defined by the shape of the curved side 154. Some of the rebar supports 106 are lined in rows located above respective the straight sides 150 and 152. The form 160 has a shape that is axially symmetric. Thus, the two straight sides 150 and 152 can be joined to the respective straight sides of the form 160 by joining the rebar supports lined up above the sides 150 and 152 of the form 140 to the rebar supports lined up above the straight sides of the form 160. The curved side 154 of the form 160 and the corresponding curved side 164 of the form 160 form a loop. The embodiment of FIG. 15 can be used to create a foundation that encircles a vertical element, such as column, lighting pole, electric pole. The foundation is joined to piles fixed to the soil via connection units 104 (described above and further described below) of the forms 140 and 160, in order to stabilize and provide support to the vertical element. This support and stabilization would decrease the chance of the vertical element being knocked down by string winds, earthquakes, and other forces.

It should be noted that the each of the curved sides 154 and 164 can be replaced by a plurality of straight sides at angles with each other, such that a loop is created the forms 140 and 160 are joined to each other.

In some embodiments of the present invention, the rebar supports 106 are lined up, such that a first row of rebar supports is located above a second row of rebar supports. In this manner on each side, one row is used to support and hold rebars while the other row is used for being connected to a connector to join the form to another form or to a wall. For example. On sides A and B, the rebars 114 are held by the rebar supports on the bottom row, leaving the rebar supports on the upper row free to be joined to connectors 116, while on sides C and D the rebars 114 are held by the rebar supports on the upper row, leaving the rebar supports on the lower row free to be joined to connectors 116. In the example of FIG. 1, this enables to form to hold a first group of rebars extending along a latitudinal direction above a second group of rebars extending along a longitudinal direction, creating a crisscrossing arrangement that strengthens the structure of the foundation. In some embodiments of the present invention, the rebars 114 sandwich the connection unit(s) 104, such that the rebars 114 held by rebar supports on the lower rows are below the connection unit(s) 104 while the rebars 114 held by the rebar supports on the upper rows are above the connection unit(s) 104.

In some embodiments of the present invention, successive rebar supports of the upper row are joined by horizontal rigid rods 118. The rebar supports of the lower row on the same side are joined to the respective rebar supports on the upper row by vertical rigid rods 119. Spacers 120 are joined to at least two rebar supports on the lower row and to the base plate 102, to keep the rebar supports 106 above the base plate 102.

As seen in FIG. 2, in some embodiments of the present invention, the rebar supports 106 comprise pipe segments extending parallel to the base plate. The rebars 114 are inserted into the pipe segments, and each rebar is held by two pipe segments located on different (e.g., opposite) sides of the form.

Referring back to FIG. 1, structure anchorage rods may be joined to the modular form and extend upward from the base plate. The structure anchorage rods are configured for being joined to vertical structural elements (columns, walls, etc).

FIGS. 5-8 illustrate cross sectional views for portions of the base plate with different manners for connecting the knock-outs to the remainder of the base plate, according to some embodiments of the present invention.

Figure 5:
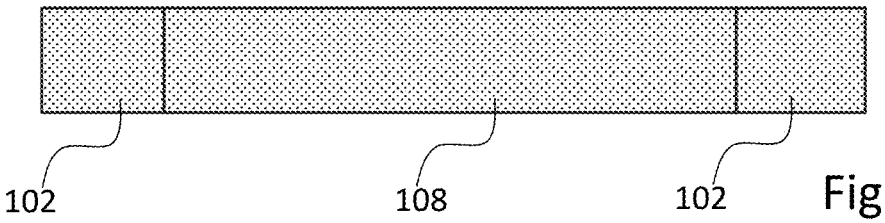
Figure 6:
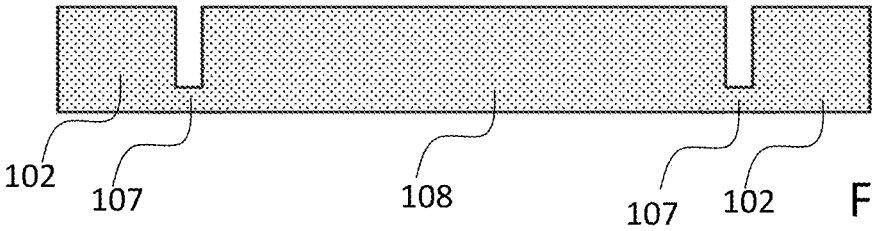
Figure 7:
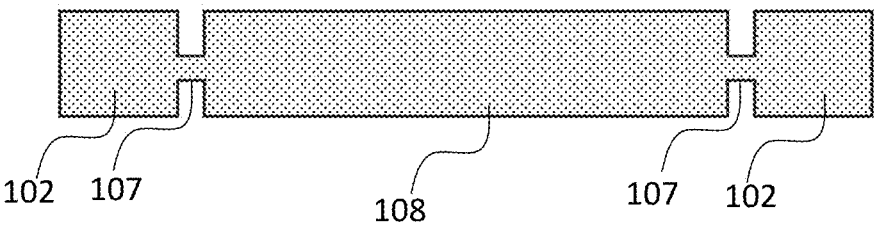
Figure 8:
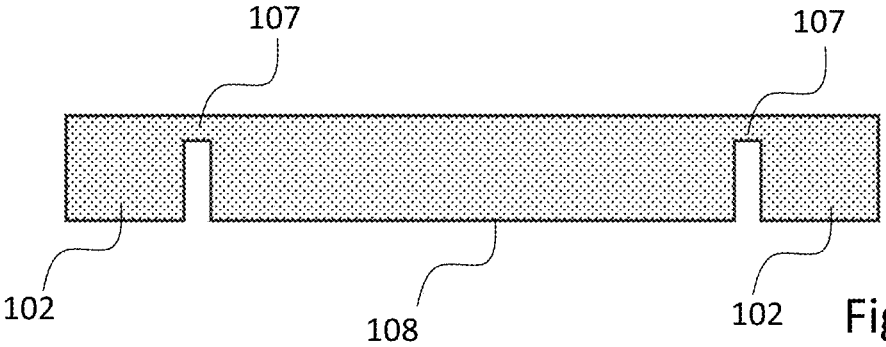

In the example of FIG. 5, the knock-out 108 is pressed fit to the base plate 102. In the example of FIGS. 6-8, the knock-out 108 is integral with the base plate 102. The section 107 at the perimeter or circumference of the knock-out 108 are thinner than base plate 102, an therefore easier to break away, thus releasing the knock-out 108 from the base plate 102. In FIG. 6, the section 107 is at the bottom of the base plate 102. In FIG. 8, the section 107 is at the top of the base plate 102. In FIG. 7, the section 107 is between the bottom and the top of the base plate 102.

FIG. 9 illustrates a cap configured to receive a pile 112, to connect the pile to the modular form, according to some embodiments of the present invention. FIG. 10 is a cross sectional view of the cap, according to some embodiments of the present invention.

In some embodiments of the present invention, each connection unit 104 comprises an open or closed loop configured to be traversed by a pile 112. The pile 112 may be held by the connection unit 104, for example, by being screwed to the connection unit 104.

In some embodiments of the present invention, the form further includes an end cap 400 configured to receive the pile within the cap 400 and be secured to the pile 112. The cap 400 has an upper section 402 and a lower section 404. The upper section 402 is larger than the loop forming the connection unit 104 and the lower section having 404 an outer surface configured to traverse the loop. Thus, when the pile is secured to the cap 400, the top section 402 of the cap is located above the loop section, preventing form moving upward with respect to the pile 112.

In some embodiments of the present invention, the lower section 404 of the cap 400 has an outer threading 406 on the outer surface of the lower section of the cap.

In some embodiments of the present invention, the cap 404 has an inner threading 408 configured to cooperate with a threading of the pile, such that the cap 400 is configured to be secured to the pile via cooperation between the cap's inner threading 408 and the threading of the pile 112.

Referring back to FIG. 2, in some embodiments of the present invention, the modular form includes a threaded nut 500 configured to cooperate with the cap's outer threading 406 of the lower section of the cap 400. The threaded nut 500 is larger than the loop. The cap is sized such that a portion of the lower section of the cap 400 passes thorough the loop when the cap 400 is secured to the loop. In this manner, the nut 500 is joined to the outer threading 406 of the lower section of the cap 400 under the loop, thus securing the cap 400 to the form both above the loop and below the loop.

FIG. 11 illustrates an example in which the connection unit 104 is a single loop located about crossing throughs, according to some embodiments of the present invention. In some embodiments of the present invention, the modular form includes a single connection unit 104 aligned with a single perforation, which may or may not be covered by a knock-out.

In some embodiments of the present invention, the base plate 102 has a recessed trough 600 under at least one of the one or more connection unit 104. The recessed trough 600 enables the form to hold more cement near the perforation traversed by the pile, thus securing the pile to the form more strongly once the cement has dried around the pile.

In some embodiments of the present invention, the modular form has a single connection unit 104. The recessed section is located under the single connection unit. In a variant, the recessed section is shaped as at least two troughs 600 and 602 crossing each other under the single connection unit.

FIG. 12 illustrates the connection unit of FIG. 11, with a plurality of support brackets supporting the connection unit, according to some embodiments of the present invention.

The support brackets 700 are joined to an upper surface of the base plate 102 and to at least one of the connection units 104 to support the connection unit above the base plate 102.

In a variant, the bracket support brackets 700 are an angling bracket configured to change an angle the connection unit 104 with respect to the base plate. For example, each support bracket 700 may include a slit 702. The slit 702 is traversed by one or more fastener 704 joined to the connection unit 104, such that the bracket 700 is located between a head of the fastener (which is larger than the slit) and the connection unit 104. The fasteners may be loosened from the connection unit 104, enabling motion of the connection unit 104 with respect to the bracket(s) 700. Once the connection unit 104 has reached a desired height along a bracket, the fastener is tightened, thereby securing the connection unit to the fastener at the desired height. The connection unit 104 may thus secured to the brackets at different heights. In this manner, the angle of the connection unit 104 with respect to the base plate 102 can be changed. This is advantageous, as the piles may have different orientations, and the orientation of the connection units 104 can be changed to ensure that the base plate remains at a desired angle with the respect to the horizontal.

The fasteners may be, for example, screws or bolts that can be screwed into an out of the connection unit 104.

FIG. 13 illustrates an example in which the connection unit includes a plurality of parallel (optionally coplanar) loops joined together, and one of the support brackets supporting the connection unit, according to some embodiments of the present invention.

In some embodiments of the present invention, the connection unit includes a plurality of parallel loops joined together. The loops may be coplanar. This configuration enables a plurality of piles to be joined to a single form. Moreover, this configuration enables a user to select the loop(s) into for connecting to the form, thus giving the user a higher degree of freedom when planning the construction.

Referring back to FIG. 11, in some embodiments of the present invention, post tension cabling may be placed between walls 300. The form may include cabling supports 800 to hold the post tension cabling. In some embodiments of the present invention, Also, it shows how the cabling support protrudes through the side of the form wall. The walls may have knock-outs that are removable to expose openings configured to be traversed by the post tension cabling and by the cabling supports 800. The post tension cabling may thus be placed on the cabling supports 800 and exit the walls to be connected a jack for tensioning prior to the pouring and curing of cement into the form and around the cabling. Once the cement is cured, the portions of the post tension cabling protruding outside the form can be cut.

What is claimed is:

1. A modular form comprising:

a base plate having a plurality of sides and at least one knock out, each of the at least one knock out being configured to be removed to generate a respective perforation configured to be traversed by a pile;

one or more connection units aligned with a respective one of the at least one knock out, the connection units being joined to the base plate and held above the base plate, each connection unit being configured to receive a pile to establish a connection between the pile and the form;

a plurality of rebar supports configured to support rebars above the base plate, wherein at least some of the rebar supports are configured to be joined to a portion of a connector, such that a remaining portion of the connector is:

joinable to a rebar support of a second modular form, thereby joining the modular form to the second modular form; or joined to a form wall, thereby joining the modular form to the form wall, such that the form wall contacts the base plate and rises from the base plate; and at least one support bracket joined to an upper surface of the base plate and to at least one of the connection units.

2. The modular form of claim 1, wherein at least some of the rebar supports are lined in at least one row, each row located above and along a respective straight side of the base plate, wherein a rebar is supported by a pair of the rebar supports.

3. The modular form of claim 2, wherein the at least one row comprises a first row and a second row, and wherein the rebar supports are lined up such that the first row is located above the second row and the second row is located above and along the respective straight side of the base plate.

4. The modular form of claim 1, wherein each connection unit comprises an open or closed loop configured to be traversed by a pile.

5. The modular form of claim 4, further comprising a cap configured to receive a pile within the cap and be secured to the pile, the cap having an upper section and a lower section, the upper section being larger than the loop and the lower section having an outer surface configured to traverse the loop.

6. The modular form of claim 5, wherein the lower section of the cap has an outer threading on the outer surface of the lower section of the cap, the cap's outer threading being configured to cooperate for connection to a threaded nut to secure the cap by sandwiching the loop between the upper section of the cap and the threaded nut at the lower section of the cap, thereby securing the loop to the cap.

7. The modular form of claim 5, wherein the cap has an inner threading configured to cooperate with a threading of the pile, such that the cap is configured to be secured to the pile via cooperation between the cap's inner threading and the threading of the pile.

8. The modular form of claim 1, wherein the rebar supports comprise pipe segments extending parallel to the base plate.

9. The modular form of claim 8, comprising one or more connectors, each of the connectors comprising a tube configured to partially enter any of the pipe segments and be secured to any of the pipe segments via circumferential pressure between the tube and the pipe segment.

10. The modular form of claim 1, wherein the at least one support bracket is an angling bracket configured to change an angle of the at least one of the connection units with respect to the base plate.

11. The modular form of claim 1, further comprising structure anchorage rods joined to and extending upward from the base plate.

12. The modular form of claim 1, further comprising cabling supports configured to retain post tension cabling.

13. The modular form of claim 1, wherein the base plate has a recessed trough under at least one of the one or more connection units.

14. The modular form of claim 13, wherein:

the one or more connection units is a single connection unit; and the recessed trough is located under the single connection unit.

15. The modular form of claim 14, wherein the recessed trough comprises at least two troughs crossing each other under the single connection unit.

16. The modular form of claim 1, wherein the base plate comprises two straight sides that do not touch each other and are in line with each other along a straight axis.

17. The modular form of claim 16, wherein the base plate comprises a curved side or a plurality of sides at non-zero angles with each other, located between the two straight sides, such that the form is shaped like half a loop defined by the shape of the curved side or the plurality of sides at non-zero angles with each other.

18. A modular form comprising:

a base plate having a plurality of sides and at least one knock out, each of the at least one knock out being configured to be removed to generate a respective perforation configured to be traversed by a pile;

one or more connection units aligned with a respective one of the at least one knock out, the connection units being joined to the base plate and held above the base plate, each connection unit being configured to receive a pile to establish a connection between the pile and the form;

a plurality of rebar supports configured to support rebars above the base plate, wherein at least some of the rebar supports are configured to be joined to a portion of a connector, such that a remaining portion of the connector is:

joinable to a rebar support of a second modular form, thereby joining the modular form to the second modular form; or joined to a form wall, thereby joining the modular form to the form wall, such that the form wall contacts the base plate and rises from the base plate; and wherein the base plate has a recessed trough under at least one of the one or more connection units.

19. A modular form comprising:

a base plate having a plurality of sides and at least one knock out, each of the at least one knock out being configured to be removed to generate a respective perforation configured to be traversed by a pile;

one or more connection units aligned with a respective one of the at least one knock out, the connection units being joined to the base plate and held above the base plate, each connection unit being configured to receive a pile to establish a connection between the pile and the form, wherein each connection unit comprises an open or closed loop configured to be traversed by a pile;

a plurality of rebar supports configured to support rebars above the base plate, wherein at least some of the rebar supports are configured to be joined to a portion of a connector, such that a remaining portion of the connector is:

joinable to a rebar support of a second modular form, thereby joining the modular form to the second modular form; or joined to a form wall, thereby joining the modular form to the form wall, such that the form wall contacts the base plate and rises from the base plate; and a cap configured to receive a pile within the cap and be secured to the pile, the cap having an upper section and a lower section, the upper section being larger than the loop and the lower section having an outer surface configured to traverse the loop.

* * * * *